United States Patent [19]

Khimenko et al.

[11] 4,143,532

[45] Mar. 13, 1979

[54] INDUCTOR FOR FORMING METALS BY THE PRESSURE OF A PULSED MAGNETIC FIELD

[76] Inventors: Lev T. Khimenko, p/o Pokotilovka, ulitsa Ulyanovskaya, 35; Alexandr T. Mezhuev, ulitsa Sverdlova, 152 "A", kv.59; Anatoly V. Legeza, p/o Merefa, ulitsa Sportivnaya, 29; Andrei K. Sljusarev, ulitsa Rybalko, 21/15, kv.21; Anatoly D. Gavrjuschenko, ulitsa Vorovskogo, 22, all of Kharkov; Vyacheslav A. Chudakov, ulitsa Anri-Barbjusa, 22, kv.48, Kiev; Mikhail I. Baranov, ulitsa Galana, 3, kv.30, Kharkov, all of U.S.S.R.

[21] Appl. No.: 847,858

[22] Filed: Nov. 2, 1977

[51] Int. Cl.[2] ..... B21D 26/02

[52] U.S. Cl. ..... 72/56; 29/421 M; 72/DIG. 30

[58] Field of Search ..... 72/56, DIG. 26, DIG. 30; 29/421 M

[56] References Cited

U.S. PATENT DOCUMENTS

| | | | |
|---|---|---|---|
| 3,391,558 | 7/1968 | Deeg | 72/56 |
| 3,412,590 | 11/1968 | Lippmann et al. | 72/56 |
| 3,823,589 | 7/1974 | Tikhonovich | 72/56 |
| 3,842,630 | 10/1974 | Mikhailov | 72/56 |
| 3,896,647 | 7/1975 | Mikhailov | 72/56 |

*Primary Examiner*—Leon Gilden

*Attorney, Agent, or Firm*—Fleit & Jacobson

[57] ABSTRACT

An inductor for forming metals by the pressure of a pulsed magnetic field comprises a magnetic field concentrator with a coil inducing eddy currents therein, the concentrator being made up of electrically insulated dies with an opening for the workpiece, so arranged that the plane in which the concentrator is split extends along said opening. Such a design of the inductor permits improving the power characteristics thereof, simplifies its operation, extends its service life, and enhances its efficiency. It also permits forming a wide variety of components.

7 Claims, 3 Drawing Figures

INDUCTOR FOR FORMING METALS BY THE PRESSURE OF A PULSED MAGNETIC FIELD

The present invention relates to devices for metal forming, and more particularly to inductors for forming metals by the pressure of a pulsed magnetic field.

The invention can most advantageously be used in assembly operations, in particular, in joining components having a closed contour by squeezing (joining of pipes, joining of long components), as well as in forming of components with a developed end portion (e.g., achieving a permanent connection of a cable thimble with a cable).

To manufacture such components, the inductor must be made split to enable withdrawal of the formed components therefrom.

There is known as apparatus for electromagnetically forming a metallic workpiece (cf. U.S. Pat. No. 3,347,074; IPC: B 21*d* 26/16; Feb. 25, 1969), comprising a split magnetic field concentrator made up of two electrically conducting dies with a recess for the workpiece, on whose surface eddy currents are concentrated to induce eddy currents in the workpiece. The plane in which the concentrator is split extends along the recess. Arranged on the outer surface of the concentrator, concentrically with the recess, is a coil inducing eddy currents in the concentrator.

The dies are made adjustable, and the electric contact is accomplished along the plane in which the concentrator is split.

Such a design with split concentrator and an electric contact between its dies along said plane results in sticking and, in some cases, fusion of the dies with heavy currents flowing through the area of contact, whereby it becomes difficult to separate the concentrator dies and the power characteristics of the apparatus are substantially deteriorated.

In addition, such a design of the concentrator results in erosion of the contacting surfaces of the concentrator dies, whereby they are put out of operation, the inductive coupling of the concentrator with the workpiece is adversely affected, and the quality of forming is lowered. The concentrical arrangement of the coil on the die surface does not permit forming components having a closed contour.

It is an object of the present invention to improve the efficiency of a metal forming inductor by eliminating the electric contact between different portions of the concentrator.

Another object of the invention is to extend the range of components that can be formed in such an inductor.

Still another object of the invention is to simplify the operation of the inductor.

These objects are attained by that in an inductor for forming metals by the pressure of a pulsed magnetic field, comprising a magnetic field concentrator with a coil inducing eddy currents therein, the concentrator being made up of dies adjustable with respect to one another and having an opening whose axis is parallel to the plane in which the concentrator is split and which extends along said opening, with eddy currents being concentrated on the concentrator surface to induce eddy currents in a workpiece, according to the invention, the dies are electrically insulated from one another, and the coil inducing eddy currents in the concentrator is located on at least one die of the concentrator.

One of the concentrator dies should preferably be stationary and accommodate the coil inducing eddy currents in the concentrator.

In order to equalize the electrodynamic forces acting upon the workpiece, the coil should preferably be located on two extreme dies of the concentrator.

Such an embodiment of the invention permits improving the power characteristics of the inductor (the inductor efficiency is increased by 20%), rules out the possibility of fusion of the concentrator dies, simplifies operation of the inductor, prolongs its surface life, and enhances its output capacity.

The inductor of the present invention permits substantially extending the range of components (including long components and components having a closed contour), as well as improving the quality and accuracy of forming.

Other objects and advantages of the invention will become more fully apparent from the following description of specific embodiments thereof, taken in conjunction with the accompanying drawings, wherein.

The direction of eddy currents is indicated by arrows.

Figure 1:
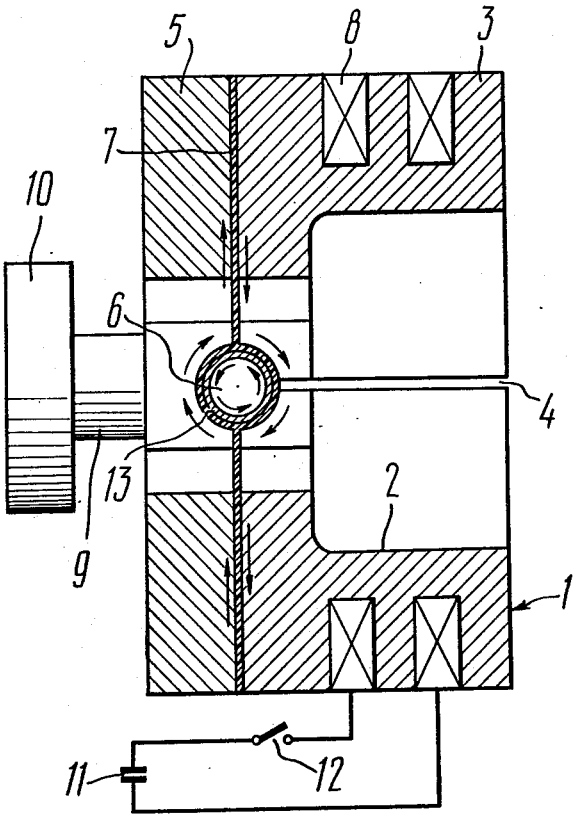
FIG. 1 is a general longitudinal section view of an inductor with a concentrator made up of two dies, according to the invention.

Referring to FIG. 1, the inductor for forming metals by the pressure of a pulsed magnetic field comprises an electrically conducting solid cylindrical concentrator 1 with an axial stepped opening 2, the concentrator being made up of two dies. One die is essentially a hollow cylinder 3 with an insulating slot 4. The other die is made as an electrically conducting disc 5.

Made in the concentrator 1 is an opening 6 whose axis extends along the plane in which the concentrator is split and which is normal to the axis of the concentrator 1, the axis of the opening 6 and that of the concentrator 1 intersecting each other.

Depending on the range of components to be formed, the concentrator 1 may be provided with more than one such opening. In addition, these openings may vary in diameter.

The concentrator dies are electrically insulated from each other by means of an insulating liner 7 placed between the hollow cylinder 3 and disc 5, the liner being made from polyethyleneterephthalate, polyfluoroethylene and other insulating materials.

On the outer surface of the hollow cylinder 3, recesses are made, accommodating a coil 8 inducing eddy currents in the hollow cylinder 3.

The slot 4 associates the surfaces of the recesses of the coil 8 with the end surface of the hollow cylinder 3.

The disc 5 is associated, through a rod 9, with a drive 10 which moves the disc 5 along the axis of the concentrator 1.

The coil 8 is coupled to a capacitor 11 via a switch 12. A workpiece 13 is inserted into the opening 6.

The above-described inductor operates as follows:

As the switch 12 is closed, the capacitor 11 discharges into the coil 8. When the coil 8 is energized, eddy currents are induced in the walls of the recesses made in the hollow cylinder 3, which currents form a closed loop through the slot 4 over the end surface of the hollow cylinder 3.

The current through the end surface of the hollow cylinder 3 induces, in turn, eddy currents in the disc 5.

The currents induced on the mating surfaces of the disc 5 and hollow cylinder 3 further induce a current in the workpiece 13 placed in the opening 6. The interaction of the eddy currents induced on the surfaces of the opening 6 and workpiece 13 causes deformation of the latter. The process of forming being over, the disc 5 is actuated by the drive 10 via the rod 9 to move along the axis of the concentrator 1, whereby the workpiece 13 is withdrawn from the opening 6.

Figure 2:
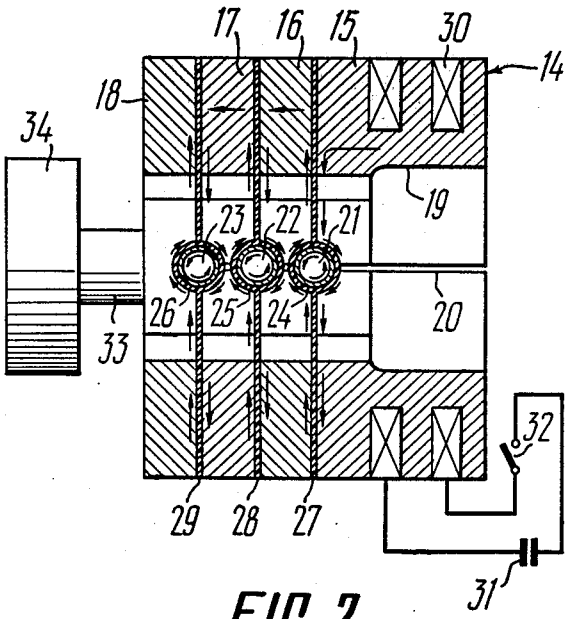
FIG. 2 is a longitudinal section view of another embodiment of the inductor with a concentrator made up of four dies, according to the invention.

Turning now to FIG. 2, another embodiment of the inductor is shown therein, which increases its capacity. A concentrator 14 is made up of four dies: one being made as a hollow cylinder 15, while the other three are made as electrically conducting discs 16, 17 and 18. The concentrator 14 has a stepped opening 19. An insulating slot 20 extends along the hollow cylinder 15 all the way to the discs 16 and 17.

The concentrator 14 is provided with at least three openings 21, 22 and 23 whose axes extend along the plane in which the concentrator 14 is split, between the cylinder 15 and discs 16, 17 and 18, intersecting the axis of the concentrator 14. These openings accommodate workpieces 24, 25 and 26.

The dies are electrically insulated from one another by linings 27, 28 and 29.

Made on the outer surface of the hollow cylinder 15 are recesses accommodating a coil 30 inducing eddy currents in the hollow cylinder 15. The coil 30 is connected to a capacitor 31 via a switch 32.

The discs 16, 17 and 18 are linked, via a rod 33, to a drive 34 which actuates the discs 16, 17 and 18 to move along the axis of the concentrator 14.

The above-described inductor operates in the following manner:

As the switch 32 is closed, the capacitor 31 discharges into the coil 30. As a result, currents are induced on the surface of the recesses in the hollow cylinder 15, which form a closed loop through the slot 20 over the end surface of the hollow cylinder 15, which extends along the plane in which the concentrator 14 is split.

The current through the end surface of the hollow cylinder 15 induces a current on the surface of the electrically conducting disc 16, facing the cylinder 15, which current flows over said surface and through the insulating slot 20 extending over the disc 16 and forms a closed loop on the opposite surface of the disc 16, i.e., on the surface facing the disc 17, then, on the surface of the disc 17, facing the disc 18.

The currents induced on the mating surfaces flow around the openings 21, 22 and 23 accommodating the workpieces 24, 25 and 26 and, interacting with the currents through the workpieces 24, 25 and 26, causes their deformation.

Figure 3:
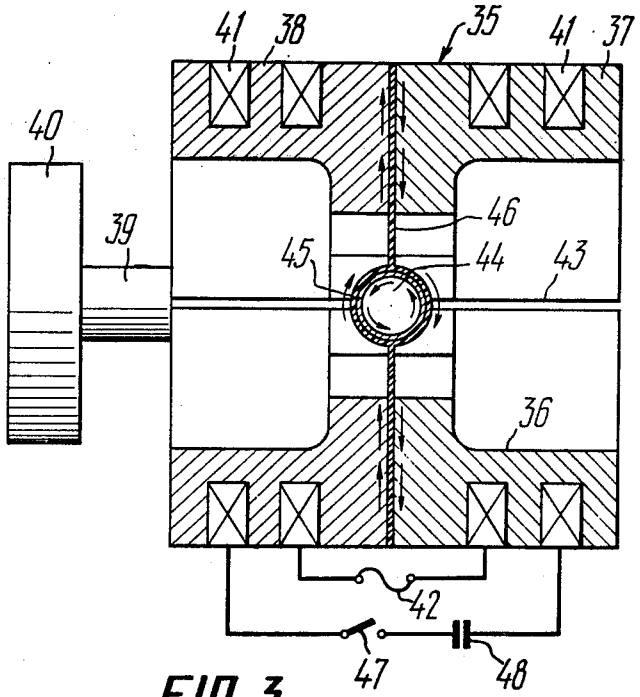
FIG. 3 is a longitudinal section view of a third embodiment of the inductor with a coil located on the extreme dies of the concentrator, according to the invention.

FIG. 3 shows an inductor in which the electromagnetic pressure on a workpiece can be equalized. To this end, the inductor comprises a magnetic field concentrator 35 with an axial stepped opening 36. The concentrator 35 is made up of two dies in the form of hollow cylinders 37 and 38, one cylinder 37 being stationary and the other cylinder 38 being coupled, via a rod 39, with a drive 40 which actuates the cylinder 38 to move along the axis of the concentrator 35.

A coil 41 inducing eddy currents in the concentrator 35 is placed in recesses made on the outer surfaces of the cylinders 37 and 38, i.e., on both dies of the concentrator. The coil 41 has a flexible connector 42. The concentrator 35 is provided with an insulating slot 43 associating the surfaces of the recesses in the hollow cylinders 37 and 38 with the end surfaces of these cylinders, facing each other.

As opening 44 is made in the concentrator 35, at a right angle to its axis, extending wherealong is the plane in which the concentrator 35 is split. The opening 44 is intended to accommodate a workpiece 45. The mating surfaces of the cylinders 37 and 38 are separated by an insulating liner 46. The coil 41 is connected, via a switch 47, to a capacitor 48.

The coil 41 induces eddy currents, in opposite directions, on the end surfaces of the hollow cylinders 37 and 38 of the concentrator 35. As these currents flow around the opening 44, eddy currents are induced in the workpiece 45. The electrodynamic interaction of the currents causes deformation of the workpiece 45. The geometry and electric parameters of the hollow cylinders 37 and 38 in the plane in which the concentrator is split being identical, equal currents flow over the end surfaces of these cylinders 37 and 38. This ensures uniform deformation of the workpiece 45 over its contour.

What is claimed is:

1. An inductor for forming metals by the pressure of a pulsed magnetic field, comprising:
   - a magnetic field concentrator split in at least one plane;
   - at least two dies of said concentrator;
   - said dies of said concentrator being spatially adjustable relative to each other;
   - a coil located on at least one said die of said concentrator;
   - said coil inducing eddy currents in said concentrator;
   - at least one opening made in said concentrator, having an axis extending along said plane in which said concentrator is split and said axis being perpendicular to the longitudinal axis of said magnetic field concentrator;
   - a surface of said opening, concentrated whereon are eddy currents inducing eddy currents in a workpiece;
   - a means for electrically insulating said dies of said concentrator.

2. An inductor as claimed in claim 1, comprising:
   - one said die of said concentrator, which is stationary;
   - said coil being located on said stationary die of said concentrator.

3. An inductor as claimed in claim 1, comprising:
   - two extreme dies of said concentrator;
   - said coil being located on said two extreme dies of said concentrator.

4. An inductor as claimed in claim 2, comprising:
   - two extreme dies of said concentrator;
   - said coil being located on two extreme dies of said concentrator.

5. An inductor as claimed in claim 1, further comprising:
   - means for adjusting one of said dies relative to the other whereby said opening is made accessible for the insertion or removal of the metals being formed therein.

6. An inductor as claimed in claim 1, comprising two dies of said concentrator, each being formed as a hollow cylinder.

7. An inductor as claimed in claim 1, wherein said stationary die is formed as a hollow cylinder and said adjustable die is formed as a disc.

* * * * *